US005477830A

United States Patent [19]

Beck et al.

[11] Patent Number: 5,477,830

[45] Date of Patent: Dec. 26, 1995

[54] ELECTRONIC FUEL INJECTION SYSTEM FOR INTERNAL COMBUSTION ENGINES HAVING A COMMON INTAKE PORT FOR EACH PAIR OF CYLINDERS

[75] Inventors: Niels J. Beck, Bonita; Robert L. Barkhimer, Poway; William P. Johnson, Valley Center, all of Calif.

[73] Assignee: Servojet Products International, San Diego, Calif.

[21] Appl. No.: 177,630

[22] Filed: Dec. 30, 1993

[51] Int. Cl.[6] ..... F02M 29/00

[52] U.S. Cl. ..... 123/470; 123/478; 123/527

[58] Field of Search ..... 123/431, 481, 123/470, 478, 472, 527, 526, 27 GE, 529, 536

[56] References Cited

U.S. PATENT DOCUMENTS

| | | | |
|---|---|---|---|
| Re. 33,270 | 7/1990 | Beck et al. | 123/447 |
| 4,091,772 | 5/1978 | Heater et al. | 123/27 GE |
| 4,573,443 | 3/1986 | Watanabe et al. | 123/492 |
| 4,716,879 | 1/1988 | Takayama et al. | 123/590 |
| 4,742,801 | 5/1988 | Kelgard | 123/27 GE |
| 4,817,570 | 4/1989 | Morita et al. | 123/472 |
| 4,865,001 | 9/1989 | Jensen | 123/27 GE |
| 4,941,442 | 7/1990 | Nanyoshi et al. | 123/481 |
| 4,945,877 | 8/1990 | Ziegler et al. | 123/472 |
| 5,094,210 | 3/1992 | Endres et al. | 123/432 |
| 5,146,897 | 9/1992 | Hattori et al. | 123/470 |
| 5,150,691 | 9/1992 | Imajo | 123/472 |
| 5,241,935 | 9/1993 | Beck et al. | 123/300 |

*Primary Examiner*—David A. Okonsky
*Attorney, Agent, or Firm*—Nilles & Nilles

[57] ABSTRACT

An internal combustion engine has a common shared intake port for each pair of cylinders and having a primary fuel injection system capable of controlling very precisely the distribution of fuel into each cylinder by controlling the duration and timing of each injection pulse. A common fuel injector is provided for each shared intake port and is controlled so as to inject fuel into the shared intake port only during the specific intake strokes of individual cylinders. Each injector preferably takes the form of an electronic fuel injector coupled to a controller receiving signals from engine mounted sensors such as a crank angle indicator. Such electronic control permits very precise control of the duration and timing of the fuel injection pulse and also enables other injection strategies such as a skip-fire operation in which fuel injection is withheld during selected intake strokes of selected cylinders, thereby eliminating firing cycles corresponding to the selected intake strokes. The fuel injection system is usable with both compression ignition and spark ignition engines and may employ additional primary injectors and/or liquid fuel pilot injectors.

20 Claims, 3 Drawing Sheets

ELECTRONIC FUEL INJECTION SYSTEM FOR INTERNAL COMBUSTION ENGINES HAVING A COMMON INTAKE PORT FOR EACH PAIR OF CYLINDERS

BACKGROUND OF THE INVENTION

1. Field of the Invention

The invention relates to internal combustion engines and, more particularly, relates to internal combustion engines having a common or shared intake port for each pair of cylinders and to a fuel injection system for precisely controlling the distribution of fuel to such shared intake ports.

2. Discussion of the Related Art

Recent years have seen a demand for adapting existing diesel and gasoline engines to burn an alternative gaseous or liquid fuel sources. Gaseous fuels such as propane or natural gas are considered by many to be superior to both diesel fuel and gasoline because they are less expensive, provide equal or greater power with equal or better mileage, and produce much lower emissions. This last benefit renders gaseous fuels particularly attractive as fuel sources because recently enacted and pending worldwide regulations may tend to prohibit the use of either gasoline or diesel fuel in many engines.

Engines may be adapted for gaseous fuel combustion by replacing the standard fuel injection system with a gaseous fuel injection system or, in the case of diesel or other compression ignition engines, by adding a gas injection system and by modifying the diesel injection system so as to supply pilot fuel to the cylinders as may be required for compression ignition. In either case, gaseous fuel injectors are mounted on or in the vicinity of the engine and operated so as to control the quantity and timing of fuel supply to each cylinder.

Most existing internal combustion engines employ either a single port or a shared port air intake system. Single port systems employ a separate intake port for each cylinder and, if adapted to burn gaseous fuel, would require a separate injector for each cylinder. Shared port systems, on the other hand, employ a common intake port for each pair of cylinders and thus, if adapted to burn a gaseous fuel, would typically require special means such as an injection pipe to assure uniform gas flow to each cylinder.

Control of injection pulse timing has been used to optimize combustion by charge stratification. For systems with isolated air intake ports, all of the fuel charge injected into a given intake port will enter the associated cylinder irrespective of the timing and duration of the injection event. However, for engines utilizing a common intake port for each pair of cylinders, accurate control of the duration and timing of each injected fuel charge can be used to assure uniform fuel charge to each cylinder without employing a separate injector for each cylinder. Precise timing of gaseous fuel injection becomes critical during operation of an engine having shared intake ports since fuel must be allocated very precisely between the two cylinders fed by each shared port. Specifically, since timing of the start of the intake strokes of adjacent cylinders fed by a shared port may be separated by only 180° crank angle or less (only about ¼ of the period between intake strokes of a single cylinder), any injected gaseous fuel which is not drawn into the first cylinder will likely disperse and be drawn into the second cylinder during the intake stroke of the second cylinder. In the worst case scenario in which the entire injection pulse for the first cylinder occurs after the end of the intake stroke of the first cylinder and in which the injection pulse for the second cylinder occurs before or during the injection stroke of the second cylinder, double the desired fuel quantity may be fed into the second cylinder. This non-uniform supply of fuel may damage or even destroy the engine.

OBJECTS AND SUMMARY OF THE INVENTION

It is therefore an object of the invention to adapt a shared intake port type internal combustion engine to burn a gaseous or liquid alternative fuel and, more particularly, to provide a method of injecting fuel into the common intake ports of such an engine without resorting to special mechanical means to separate the fuel in either charge for each cylinder.

Another object of the invention is to control precisely the injection of fuel into a common intake port of an internal combustion engine.

In accordance with a first aspect of the invention, these objects are achieved by providing a method including providing an internal combustion engine including a first cylinder, a second cylinder, and a single shared intake port having a pair of outlets communicating with the first and second cylinders, respectively. The injection of the fuel charge is performed by injecting fuel into the common inlet of the shared intake port only during intake strokes of each of the cylinders. Injecting fuel in this manner assures that all of the fuel injected during a given pulse will be drawn into the desired cylinder by combustion air flowing into the cylinder, thereby preventing fuel from dispersing and being drawn into the other cylinder.

The fuel may be injected into the common inlet of the shared intake port from one or more injectors opening into the common inlet.

Still another object of the invention is to provide a shared intake port type internal combustion engine and a reliable fuel injection system for injecting either gaseous or liquid fuel into the common intake ports of such an engine.

In accordance with another aspect of the invention, this object is achieved by providing an internal combustion engine including a first cylinder, a second cylinder, and a common intake port having a pair of outlets communicating with the first and second cylinders, respectively. Also provided are a fuel injector having an injection nozzle communicating with a common inlet of the shared intake port, and means for controlling the timing and duration of injection pulses of the fuel injector so as to inject fuel into the common inlet of the shared intake port only during the specific and separate intake strokes of the first and second cylinders.

Preferably, the fuel injector comprises an electronic fuel injector, and the means for controlling comprises 1) sensors which monitor engine operating conditions including crank angle, and 2) a controller which receives signals from the sensors and which transmits actuating signals to the electronic fuel injector.

In order to assure adequate fuel delivery even under high load/high RPM operating conditions, at least one additional fuel injector may be provided for each common intake port. The second fuel injector can be used to supplement fuel delivered by the first injector when the engine is heavily loaded and thus requires more fuel per unit time.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and which.

DETAILED DESCRIPTION OF THE PREFERRED EMBODIMENTS

1. Resume

Pursuant to the invention, an internal combustion engine is provided having a common siamese or shared intake port for each pair of cylinders and having a primary fuel injection system capable of controlling very precisely the distribution of fuel into each cylinder by controlling the duration and timing of each injection pulse. A common fuel injector is provided for each shared intake port and is controlled so as to inject fuel into the shared intake port only during the specific intake strokes of individual cylinders. Each injector preferably takes the form of an electronic fuel injector coupled to a controller receiving signals from engine mounted sensors such as a crank angle indicator. Such electronic control permits very precise control of the duration and timing of each fuel injection pulse and also enables other injection strategies such as a skip-fire operation in which fuel injection is withheld during selected intake strokes of selected cylinders, thereby eliminating firing cycles corresponding to the selected intake strokes. The fuel injection system is usable with both compression ignition and spark ignition engines and may employ additional primary injectors and/or liquid fuel pilot injectors.

2. System Overview

Figure 1:
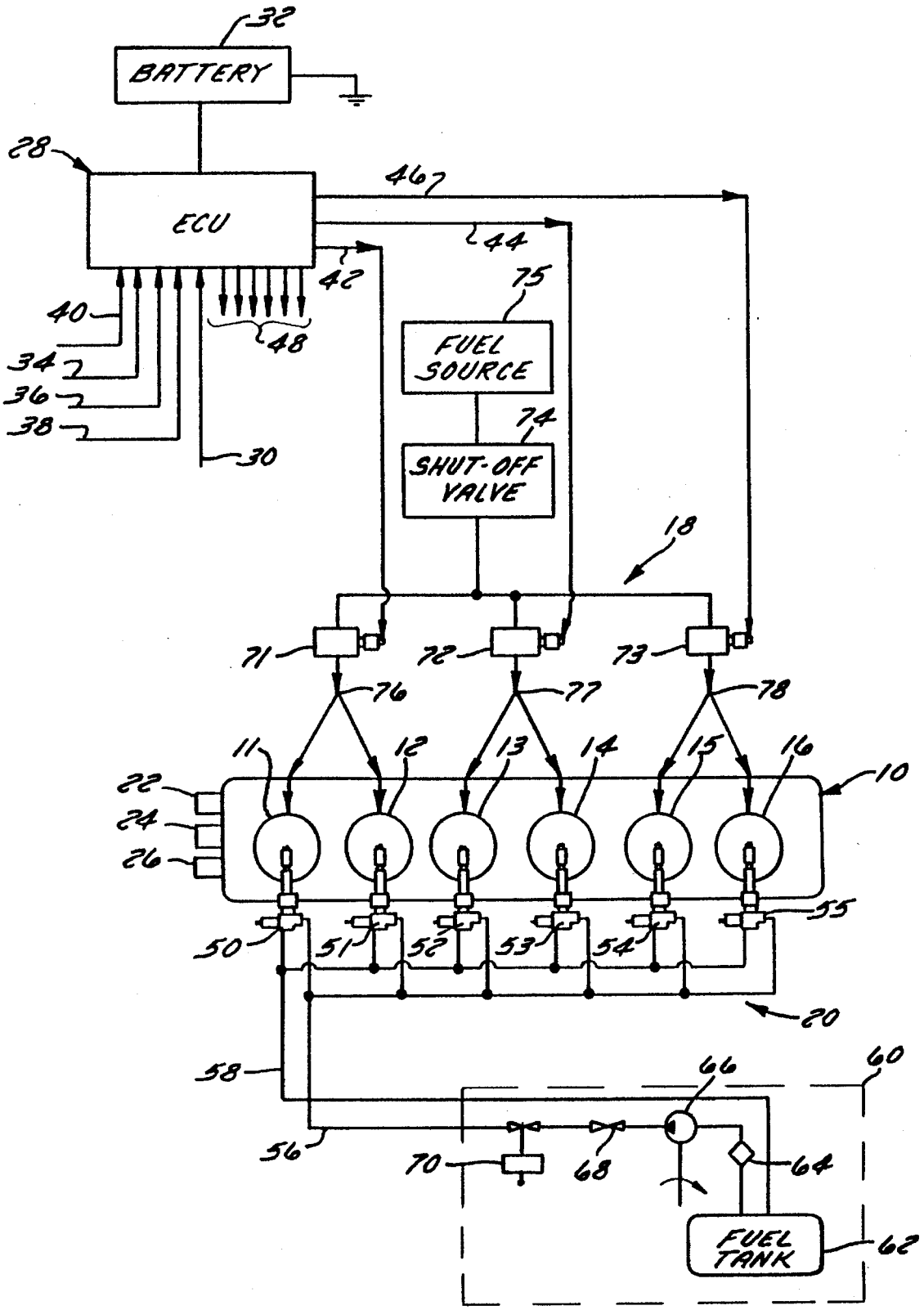
FIG. 1 schematically illustrates a dual fuel shared intake port internal combustion engine having separate gas and liquid fuel injection systems constructed in accordance with a first preferred embodiment of the present invention.
Figure 2:
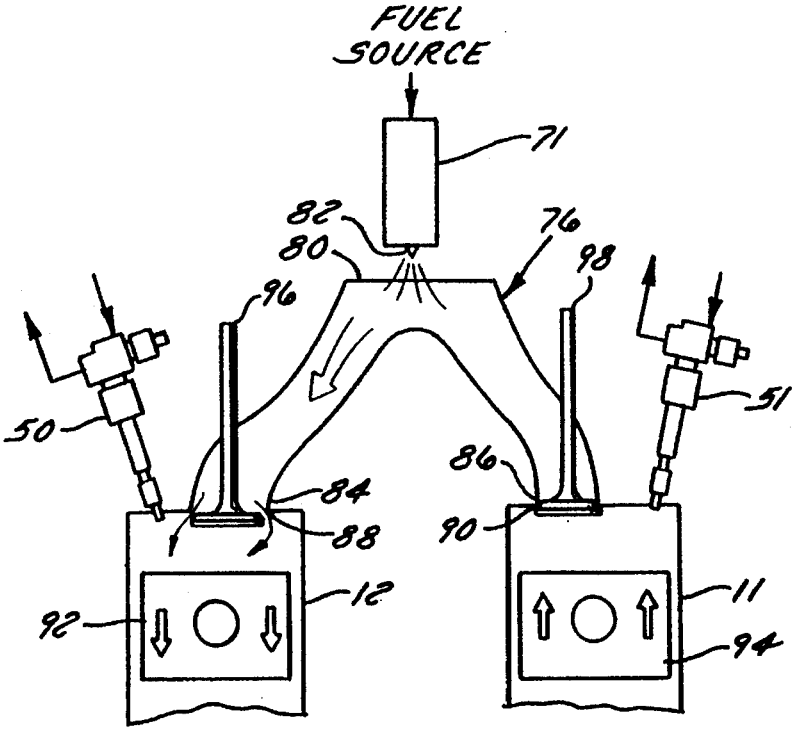
FIG. 2 is a sectional side-elevation view schematically illustrating a portion of the engine of FIG. 1.

Referring now to FIGS. 1 and 2, an internal combustion engine 10 is illustrated and has a plurality— in this case 6—of cylinders 11–16. Engine 10 could be a spark ignition engine but in the illustrated embodiment is a dual fuel compression ignition engine receiving primary fuel from a primary fuel injection system 18 and pilot fuel from a pilot fuel injection system 20. The illustrated engine 10 comprises a Cummins Model L10 diesel engine adapted to include the primary fuel injection system 18 and having its stock diesel fuel injectors modified or replaced so as to inject only small amounts of pilot fuel as required for compression ignition. Operation of the engine 10 is monitored via sensors such as an intake air temperature sensor 22, an intake manifold pressure sensor 24, and engine coolant temperature sensor 26. A controller 28, which is supplied with power from a battery 32 and which may comprise an ECU or any other suitable device, receives signals from the sensors 22, 24, and 26 via a wire 30. Other sensors, not shown, detect crank angle or otherwise detect timing pulse, diesel fuel rail pressure, and throttle position, and transmit appropriate signals to the ECU 28 via respective wires 34, 36, and 38. The ECU 28 also transmits control signals to 1) a rail pressure regulator (not shown) via a wire 40; 2) primary fuel injectors (detailed below) via wires 42, 44, and 46; and 3) secondary or pilot fuel injectors (also detailed below) via wires collectively denoted 48.

Pilot fuel injection system 20 could be formed by modifying the stock system supplied by the manufacturer so as to permit the dynamic control of rail pressure as required for pilot injection or by replacing the stock system with any other system capable of supplying sufficient diesel fuel or another pilot fuel to the engine 10 to enable compression ignition of the fuel supplied by primary fuel injection system 18. Pilot fuel injection system 20 could also be eliminated altogether if spark ignition is to be employed. However, in the illustrated embodiment, pilot fuel injection system 20 includes 6 electronic fuel injectors 50–55 having common fuel supply and return rails 56 and 58 connected to a fuel supply system 60. The fuel supply system 60 includes a fuel tank 62, a filter 64, a pump 66, a pressure relief valve 68, and a pressure regulator 70. System 60 is operable in a manner which is, per se, well known to supply fuel to and receive fuel from the injectors 50–55.

Each of the injectors 50–55 could comprise any suitable electronic or mechanical fuel injector. The illustrated injectors comprise intensified accumulator-type fuel injectors, particularly preferred examples of which are disclosed in U.S. Pat. Nos. 5,241,935 and RE 33,270 to Beck et al., the subject matter of each of which is hereby incorporated by reference. Each injector 50–55 is operable, upon actuation of an internal solenoid valve of the injector by the controller 28, to intensify the pressure of fuel fed to the injector by the common rail 56 and to inject precisely timed pulses of intensified fuel in the cylinders upon demand.

3. Construction and Operation of First Embodiment

The primary fuel injection system 18 as illustrated in FIG. 1 includes a plurality—in this case 3—electronic fuel injectors 71–73 adapted to inject gaseous or liquid fuel into the intake ports of the engine 10. In the illustrated embodiment in which a gaseous fuel such as natural gas or propane is used as the primary fuel source, each of the injectors 71–73 receives gaseous fuel from a pressurized storage tank 75 via a shut-off valve 74 and injects the gaseous fuel into the engine intake ports. Each of the valves 71–73 could be any suitable electronic fuel injector known to those skilled in the art but preferably comprises a so-called CNG (compressed natural gas) electronic fuel injector connected to the controller 28 by a respective wire 42, 44, 46 as detailed above.

Each injector 71–73 is adapted to supply fuel to a pair of cylinders via a respective siamese or shared intake port 76–78 common to both cylinders. Since each shared port 76–78 and the associated injector 71–73 and cylinders 11–16 is of identical construction, only the shared port 76 for the cylinders 11 and 12 and the associated injector 71 will be described in detail. Referring to FIG. 2, shared intake port 76 is generally Y-shaped and has an upper, common inlet 80 communicating with the injection nozzle 82 of injector 71, and a pair of outlets 84, 86 emptying into the intake openings 88 and 90 of the respective cylinders 12 and 11. The volume of the shared port 76 must be substantially less than the volume of each cylinder 11, 12 so as to assure that all of the air in port 76 is drawn into an associated cylinder 11 or 12 during the cylinder's intake stroke to assure that the fuel charge is entrained by high velocity intake air as detailed below. As is standard with such engines, the openings 88 and 90 are located above the respective pistons 92 and 94 and are closeable via actuation of conventional intake valves 96 and 98 operated ie., opened and closed, electronically or mechanically by a cam.

The operation of internal combustion 10 engine will now be described with reference to FIGS. 1–3.

The firing order of the cylinders 11–16 is standard for 6 cylinder engines, i.e., 11, 15, 13, 16, 12, 14. Thus, assuming cylinder 12 begins its intake stroke at a crank angle of 240° and completes its intake stroke at a crank angle of 420°, cylinder 11 will begin its intake stroke at a crank angle of 480° and complete its intake stroke at 660°. The beginnings of the intake strokes of the cylinders 11 and 12 are thus separated by only 240°. Precise control of the timing, frequency, and duration of fuel injection from injector 71 for the cylinders 11 and 12 is therefore critical to ensure injection only during those portions of the intake strokes of a given cylinder 11 or 12 during which combustion air flowing into the cylinder will assuredly draw fuel into that cylinder, thereby precisely controlling fuel distribution into the cylinders 11 and 12 to achieve the desired combustion characteristics.

Figure 3:
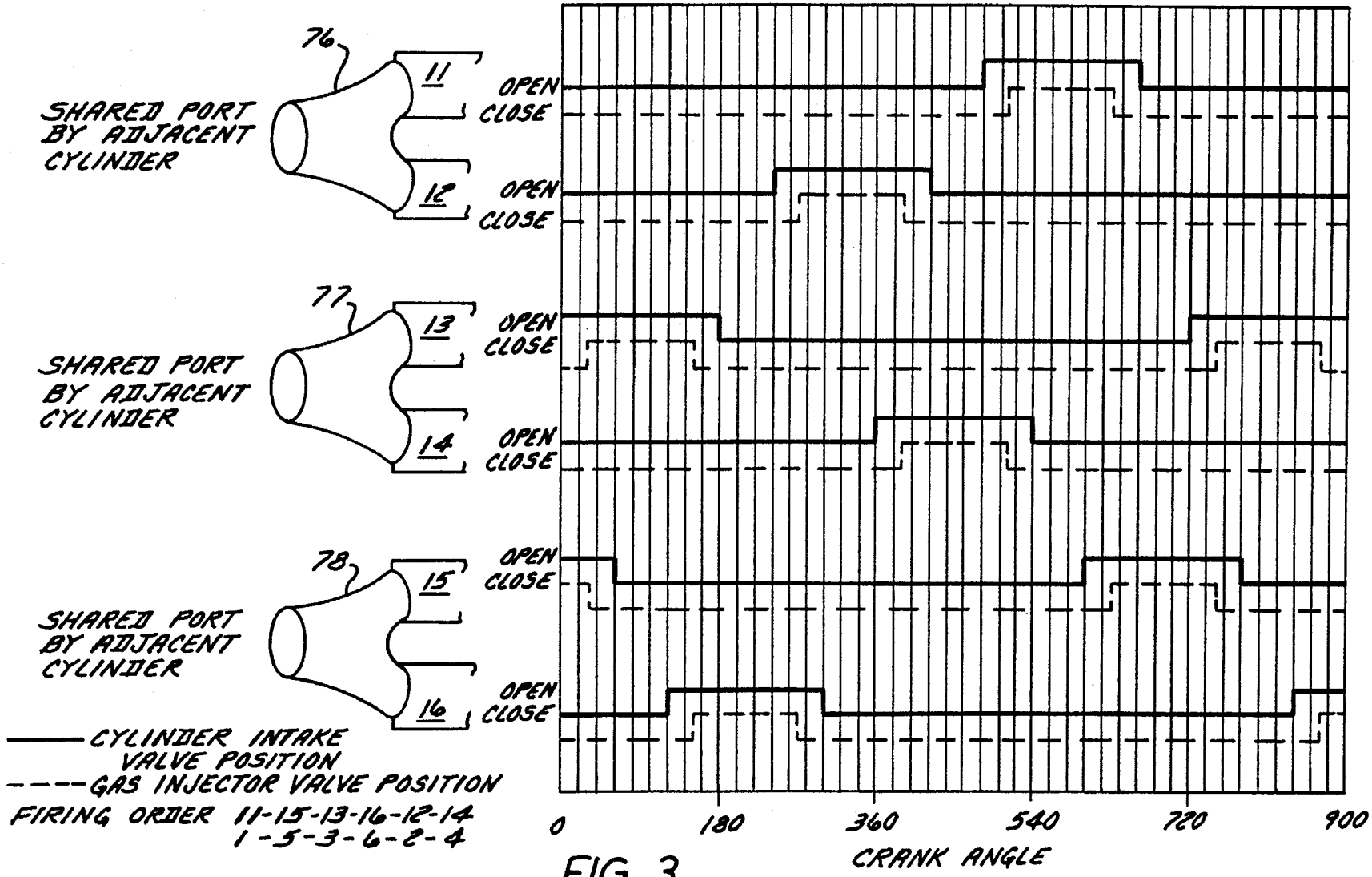
FIG. 3 is a timing chart illustrating the operation of the primary fuel injectors and intake valves for the engine of FIG. 1.

Referring to FIGS. 2 and 3, an injection pulse from injector 71 is initiated shortly after intake valve 96 opens at the beginning of the intake stroke of cylinder 12 and terminates injection well before the intake valve 96 closes at the end of the intake stroke. Preferably, this injection begins about 15° to 30° after intake valve opening and continues for about 120°, thereby correlating injection with maximum combustion airflow into the cylinder. The actual pulse duration will, of course, vary depending upon the amount of fuel demanded by the engine 10 as detected by the throttle sensor and upon engine speed. Since the intake valve 98 for cylinder 11 is closed during this injection pulse, and since the gaseous fuel charge comprises less than 10% of the total intake charge drawn into cylinder 12, the fuel charge is readily entrained by the high velocity air charge flowing into cylinder 12 through the common shared intake port 76 at a velocity on the order of 100 meters per second. Controlling the timing and duration of the injection pulse in this manner thus assures that the entire fuel charge is drawn into cylinder 12 without employing complex piping arrangements required by prior art systems. Similarly, the next injection pulse from injector 71 does not begin until after the intake valve 96 for cylinder 12 closes and the intake valve 98 for the cylinder 11 opens, and terminates well before the intake valve 96 closes, thus assuring that the entire fuel charge is entrained by the high velocity combustion air charge flowing into cylinder 11. As is conventional with dual fuel systems, the controller 28 controls operation of the respective pilot injectors 50, 51 so that pilot injection into the cylinders occurs as required for compression ignition. This control may comprise the direct control of the individual injectors if electronic injectors of the illustrated type are employed, or may comprise the dynamic control of rail pressure if mechanical injectors are employed.

Also as illustrated in FIG. 3, the operation of each of the injectors 72 and 73 is similarly controlled to control the timing, frequency, and duration of injection pulses from these injectors into shared ports 77 and 78 to avoid damage to the engine 10. Operation of the corresponding pilot injectors 52–55 is controlled accordingly.

Injection timing as thus far described could conceivably be controlled mechanically, e.g., by a cam. The described and illustrated electronic control is, however, preferred because it is controllable by software and is more adaptable. For instance, the duration of selected injection pulses can be varied independently of engine speed. Selected injection pulses can also be withheld altogether to provide a so-called "skip-fire" operation in which selected firing cycles are eliminated.

Skip-fire may be used to reduce exhaust emissions when an engine is operating under a low-load condition by increasing the air to fuel ratio in the active or firing cylinders. The effective load on the active cylinders of an engine can be increased by selectively eliminating the firing cycles of selected cylinders by withholding fuel injection during the intake strokes of the selected cylinders, thereby forcing the remaining cylinders to carry the total load. Half of the cylinders are normally disabled during a skip-fire operation. Thus, the injection pulses which would normally take place during the intake strokes of the cylinders 11, 12, and 13 are withheld by suitable operation of controller 28, thus preventing the firing cycles of these cylinders and causing the remaining cylinders 14–16 to operate under higher load, thereby reducing low-load emissions. Of course, the injection pulse for the pilot injector for the disabled cylinders should likewise be withheld during skip-firing non-firing either by direct control in the case of an electronic injector or by dynamic control of rail pressure in the case of a mechanical injector.

4. Construction and Operation of Second Embodiment

Figure 4:
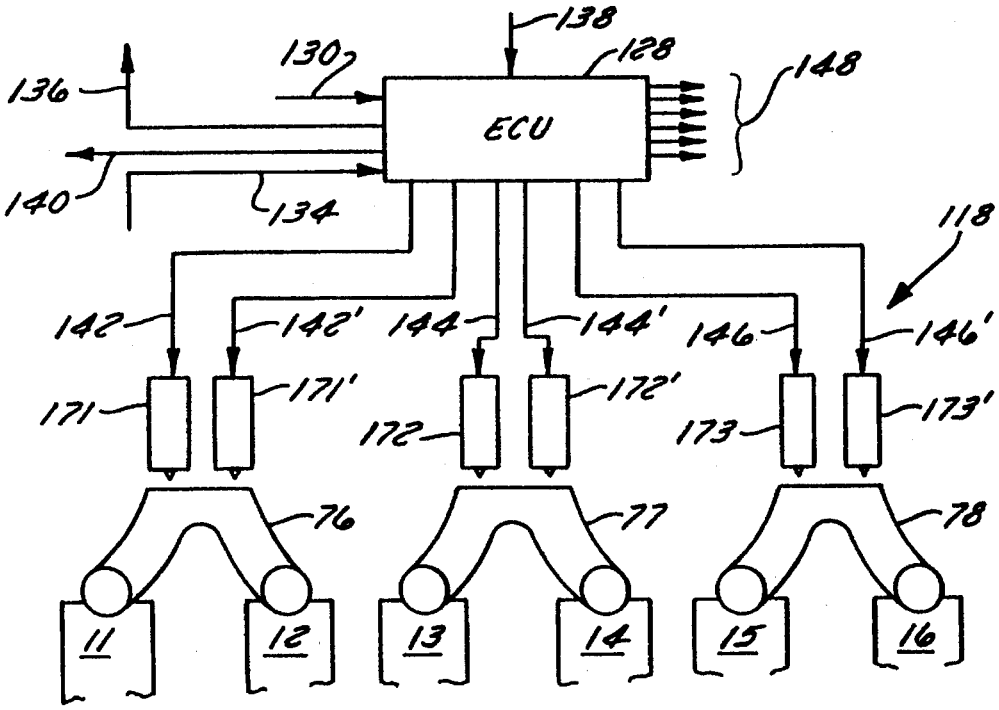
FIG. 4 schematically illustrates a primary fuel injection system usable with the engine of FIG. 1 and constructed in accordance with a second preferred embodiment of the invention.

The primary injection system 18 illustrated in FIGS. 1 and 2 functions well for most applications. However, single CNG fuel injectors may be incapable of supplying adequate fuel during an air intake stroke when certain engines are operating under high load and at high RPM. This problem can be avoided by employing the fuel injection system 118 illustrated in FIG. 4 as the primary fuel injection system for the engine 10 of FIGS. 1 and 2.

Primary fuel injection system 118 is for the most part identical to the system 18 described above. Elements of the primary injection system 118 of FIG. 4 corresponding to those of FIG. 1 are thus denoted by the same reference numerals, incremented by 100. System 118 thus includes three injectors 171, 172, 173 opening into the respective shared intake ports of engine 10. A controller 128 is powered by a battery (not shown), receives signals from wires 130, 134, 136, and 138, and transmits signals via wires 140, 142, 144, 146, and 148. The injectors 171, 172, and 173 receive fuel from a fuel source via a shut off valve (not shown).

The primary fuel injection system 118 differs from the system 18 of FIGS. 1 and 2 only in that a second CNG fuel injector 171', 172', 173' is provided at the inlet of each of each common intake port 76, 77, 78 and receives signals from controller 128 via wires 142', 144', and 146'. Providing two injectors for each common intake port permits the injection of twice the amount of fuel over a given period of time than may be injected by a single injector and thus can assure adequate fuel delivery per unit time even under high RPM/high load engine operating conditions. Additional injectors may be added as required, depending upon the demands of a given engine.

The utility of two or more separate CNG injectors per intake port can be understood more clearly with reference to Table 1. As can be seen in this table, fuel is injected from only one of each pair of injectors when the engine 10 is operating at about less than one-half load, and from both injectors when the engine 10 is operating at more than about one-half load, thereby assuring adequate fuel delivery while still employing standard injectors. Thus, in the case of cylinder 11, fuel is injected only from injector 171 when the engine 10 is operating at less than about one half load and from both injectors 171, 171' when the engine is operating at more than about one half load. Similar injection schemes for cylinders 12–16 using injectors 171, 171', 172, 172', and 173, 173' are illustrated in Table 1.

Many changes and modifications could be made to the invention without departing from the spirit thereof. The scope of such changes will become apparent from the appended claims.

| CYLINDER # | | INJECTOR CONTROL | | | | | |
|---|---|---|---|---|---|---|---|
| | | 171 | 171'© | 172 | 172© | 173 | 173© |
| 11 | | | | | | | |
| 12 | | | | | | | |
| 13 | | | | | | | |
| 14 | | | | | | | |
| 15 | | | | | | | |
| 16 | | | | | | | |

LEGEND

0±100% LOAD  50±100% LOAD

We claim:

1. A method comprising:

A. providing an internal combustion engine including
(1) a first cylinder,
(2) a second cylinder, and
(3) a shared intake port having
(A) a pair of outlets communicating with said first and second cylinders, respectively, and
(B) a common inlet communicating with said outlets; and B. injecting fuel into said common inlet of said shared intake port, wherein said injecting step comprises controlling the frequency, timing, and duration of injection pulses such that fuel is injected into said common inlet only during intake strokes of said first and second cylinders.

2. A method as defined in claim 1, wherein said injecting step comprises injecting fuel into said common inlet of said shared intake port from a single fuel injector having an injection nozzle opening into said common inlet.

3. A method as defined in claim 1, wherein said injecting step comprises injecting fuel into said common inlet of said shared intake port from at least one of multiple fuel injectors each having an injection nozzle opening into said common inlet of said shared intake port.

4. A method as defined in claim 3, wherein said injecting step further comprises injecting fuel into said common inlet of said shared intake port from fewer than all of said injectors when said engine is operating at one of a reduced speed and a reduced load, thereby injecting a reduced volume of fuel into said inlet port.

5. A method as defined in claim 4, further comprising monitoring engine operating conditions including crank angle position and engine load, and wherein said injecting step comprises electronically controlling operation of said fuel injectors based upon monitored engine operating conditions.

6. A method as defined in claim 1, further comprising monitoring engine operating conditions including engine load, and wherein said injecting step comprises electronically controlling operation of said fuel injector based upon monitored engine operating conditions.

7. A method as defined in claim 1, wherein said injecting step comprises injecting gaseous fuel into said common inlet of said shared intake port.

8. A method as defined in claim 7, further comprising injecting a pilot fuel directly into the combustion chambers of said cylinders to enable compression ignition of said gaseous fuel.

9. A method as defined in claim 1, wherein said injecting step comprises injecting a liquid fuel into said common inlet of said shared intake port.

10. A method as defined in claim 1, further comprising withholding fuel injection during selected intake strokes of at least one of said first and second cylinders, thereby selectively eliminating firing cycles corresponding to said selected intake strokes.

11. A method as defined in claim 1, wherein said controlling step comprises electronically controlling a fuel injector based upon sensed operating conditions.

12. A method comprising:

A. providing an internal combustion engine including
(1) a first cylinder,
(2) a second cylinder,
(3) a shared intake port having
(A) only first and second outlets, said first outlet supplying fuel and air to said first cylinder only, and said second outlet supplying fuel and air to said second cylinder only, and
(B) a common inlet supplying air and fuel to said outlets only, and
(4) an electronic fuel injector having an injection nozzle opening into said common inlet of said shared intake port only;

B. providing sensors which monitor engine operating conditions including crank angle;

C. providing an electronic controller which is connected to said sensors and to said electronic fuel injector; and D. controlling said electronic fuel injector via operation of said electronic controller so as to inject a gaseous fuel into said common inlet of said shared intake port, wherein said controlling step comprises controlling the frequency, timing, and duration of injection pulses such that a plurality of distinct fuel charges are injected into said common inlet, wherein each fuel charge is injected only during an intake stroke of a designated one of said first and second cylinders, thereby causing all of each fuel charge to be entrained by high velocity air flowing into the designated cylinder during the intake stroke of the designated cylinder.

13. A method as defined in claim 12, wherein said controlling step results in at least selectively injecting fuel into said common inlet of said shared intake port from another electronic fuel injector opening into said common inlet.

14. A method as defined in claim 13, wherein said controlling step results in injecting fuel into said common inlet of said shared intake port from one of said electronic fuel injectors when said engine is operating at less than about one half load and from both of said electronic fuel injectors when said engine is operating at more than about one half load.

15. A method as defined in claim 12, further comprising withholding fuel injection during selected intake strokes of at least one of said first and second cylinders, thereby selectively eliminating firing cycles corresponding to said selected intake strokes.

16. An internal combustion engine comprising:

A. a first cylinder;

B. a second cylinder;

C. a shared intake port having (1) only first and second outlets, said first outlet supplying fuel and air to said first cylinder only, and said second outlet supplying fuel and air to said second cylinder only, and (2) a common inlet supplying air and fuel to said outlets only;

D. a fuel injector having an injection nozzle opening into said common inlet of said shared intake port only; and E. means for controlling the frequency, timing, and duration of injection pulses from said fuel injector so as to inject a gaseous fuel into said common inlet of said shared intake port only during intake strokes of said first and second cylinders.

17. An internal combustion engine as defined in claim 16, wherein

A. said fuel injector comprises an electronic fuel injector, and

B. said means for controlling comprises (1) sensors which monitor engine operating conditions including crank angle, and (2) a controller which receives signals from said sensors and which transmits actuating signals to said electronic fuel injector.

18. An internal combustion engine as defined in claim 16, further comprising a second fuel injector having an injection nozzle communicating with said common inlet of said shared intake port.

19. An internal combustion engine as defined in claim 16, further comprising a pilot fuel injector having an injection nozzle communicating directly with the combustion chamber of said cylinder.

20. An internal combustion engine as defined in claim 16, further comprising means for withholding fuel injection during selected intake strokes of at least one of said first and second cylinders, thereby eliminating selected firing cycles corresponding to said selected intake strokes.

* * * * *